US005154778A

United States Patent [19]

Papazian et al.

[11] Patent Number: 5,154,778

[45] Date of Patent: Oct. 13, 1992

[54] LITHIUM LOSS SUPPRESSION IN ALLOYS USING HYDROGEN ATMOSPHERE

[75] Inventors: John M. Papazian, Great Neck; Robert L. Schulte, Port Washington; Philip N. Adler, Roslyn Heights, all of N.Y.

[73] Assignee: Grumman Aerospace Corporation, Bethpage, N.Y.

[21] Appl. No.: 583,313

[22] Filed: Sep. 17, 1990

[51] Int. Cl.[5] ..... C21D 1/74

[52] U.S. Cl. ..... 148/703

[58] Field of Search ..... 148/20.3

[56] References Cited

U.S. PATENT DOCUMENTS 4,799,976 1/1989 Meyer ..... 148/20.3

FOREIGN PATENT DOCUMENTS 2137666 10/1984 United Kingdom .

*Primary Examiner*—R. Dean
*Assistant Examiner*—Robert R. Koehler
*Attorney, Agent, or Firm*—Pollock, VandeSande & Priddy

[57] ABSTRACT

The invention utilizes a hydrogen atmosphere during the heat treatment of an Al-Li alloy. The presence of such a reducing atmosphere prevents the reaction of surface lithium atoms with atmosphere components that would cause a diffusion and subsequent depletion of lithium atoms in the region near the surface. As a result, the present invention suppresses lithium loss and consequently prevents the formation of agglomerated lithium atom vacancies which would otherwise develop into microscopic metallic porosity. The prevention of such a condition maintains high fatigue resistance and corrosion resistance in association with metallic strength.

3 Claims, 1 Drawing Sheet

LITHIUM LOSS SUPPRESSION IN ALLOYS USING HYDROGEN ATMOSPHERE

RELATED PATENT APPLICATION

This invention relates to the technology of copending U.S. Pat. application Ser. No. 07/548,236 in the name of the same inventor and assignee.

FIELD OF THE INVENTION

The present invention relates to heat treatment of aluminum alloys having a substantial lithium content.

BACKGROUND OF THE INVENTION

Aluminum alloys containing lithium (Li) are of great interest in the aerospace industry due to the possibility of producing structural components having a high strength/weight ratio. Typically, these alloys contain approximately 0.5 percent to 3.0 percent lithium by weight.

Metal manufacturers subject these alloys to heat treatment including solution heat treatment homogenization and annealing. For solution heat treatment, temperatures employed usually range 475°–575° C. At these elevated temperatures there can be a significant lithium content loss. In the case of sheets having a thin thickness, the lithium loss at these temperatures can be extensive during normal heat treatment times due to reaction of the lithium in the sheet material and the oxygen in a furnace atmosphere. The prior art includes attempts to create a furnace atmosphere that will reduce the rate of reaction. However, there are two primary considerations in a heat treatment process of aluminum/lithium alloys as regards the relationship between the lithium content and the furnace atmosphere. These include:

a) loss of lithium from the alloy, and b) formation of reaction by-products which may penetrate intergrain boundaries.

In order to better appreciate the mechanism of lithium loss, one must consider the diffusion of lithium atoms toward the surface of the material where reaction with the atmosphere takes place. The result of this diffusion is a near-surface region of the material where the concentration of lithium is less than the desired lithium concentration in the alloy. This lithium depleted region will not have the properties required of the alloy, i.e. it will be mechanically weaker, it may have different fatigue resistance corrosion resistance, etc. In addition, the result of this atomic migration is the generation of lithium atom vacancies. It has been noticed that a tendency develops for these vacancies to agglomerate thereby causing voids or "pores" in the material. The lack of adequate lithium in the near-surface material and the presence of pores, of course, weakens the metal.

The prior art has recognized that, in the latter case of penetrating by-products, the adverse effects of reaction products (in relation to the weight of such products) increases in line with the increase of volume due to the formation of such products. The penetration of the intergrain boundaries is highly undesirable in thin alloy sheet materials because of the severe loss of alloy integrity.

Another problem arising from heat treatment of aluminum-lithium (Al-Li) alloys is the loss of lithium near the surface which weakens the material and leaves the material near the surface with a high degree of porosity. From a structural point of view, such porosity is undesirable.

In published U.K. Patent Application 2,137,666 A, filed Mar. 27, 1984, and published Oct. 10, 1984, an atmosphere is proposed that is essentially a $CO_2$ atmosphere containing a definite moisture content which can be employed as at atmosphere in the heat treatment of Al-Li alloys because the introduction of small amounts of oxygen, nitrogen, and water vapor from an ambient atmosphere would not be especially deleterious in relation to the rate of attack on the Li content of the alloy. According to the published U.K. application, a heat treatment of an Al-Li alloy is carried out in an atmosphere consisting essentially of carbon dioxide having a water content controlled to be in the range of 4 to 250 Torr or even higher (about −0.6 to 31 percent by weight). However, a preferable range of 10 to 50 Torr is prescribed since it is easily achieved.

BRIEF DESCRIPTION OF THE PRESENT INVENTION

By utilizing a hydrogen atmosphere, the present invention minimizes reaction of lithium atoms with atmospheric components. As a result a near-surface region depleted of lithium does not develop and the number of atomic vacancies within the metal remains somewhat constant thereby preventing the generation of voids or "pores." Therefore, the structural strength of the alloy may be maintained during heat treatment.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Prior to a detailed description of the present invention which utilizes a hydrogen atmosphere, a prior art atmosphere employing "wet" carbon dioxide atmosphere will be discussed. The creation of such an atmosphere is taught in the previously mentioned published U.K. Patent Application 2,137,666 A. In the document the "wet" carbon dioxide atmosphere is discussed in connection with conventional heat treatment apparatus for aluminum alloys having a substantial content of lithium. Such conventional heat treatments include solution heat treatment, homogenization and annealing. The creation of a "wet" carbon dioxide atmosphere is relatively simple to achieve since this can be accomplished by supplying a furnace atmosphere with a stream of carbon dioxide gas bubbled through water at a temperature of 15° to 20° C. with a contact time sufficient to achieve substantial partial pressure of water vapor in a resulting atmosphere.

Figure 1:
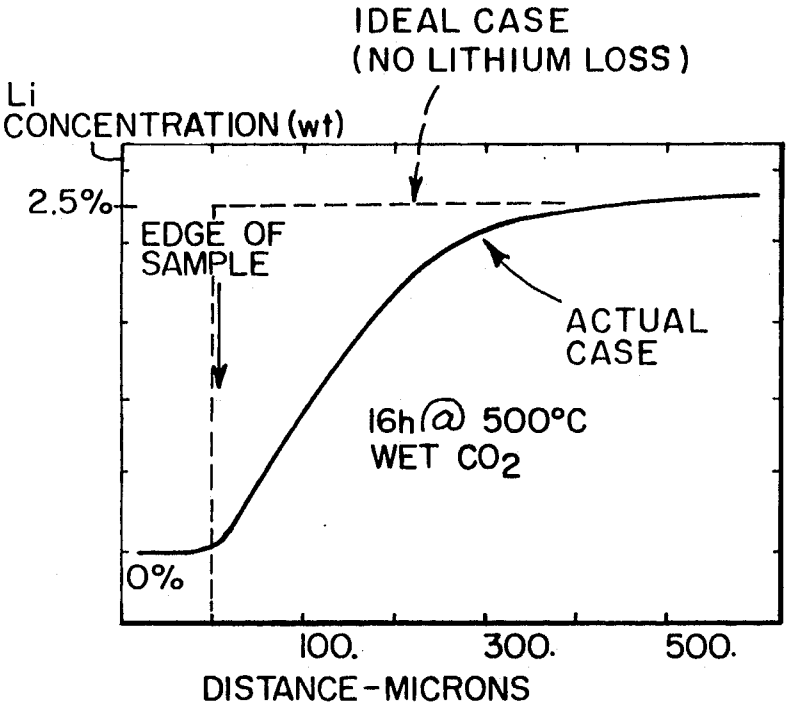
PRIOR ART FIG. 1
FIG. 1 is a graphical plot of lithium concentration in the near-surface region after heat treatment for a lithium alloy treated in a prior art $CO_2$ atmosphere. The dotted line shows the lithium concentration in the ideal case where there is no loss of lithium. The solid line shows the actual case where there is some loss of lithium.

FIG. 1 illustrates the results of heat treatment when a "wet" carbon dioxide atmosphere is present in a heat treatment furnace for an Al-Li alloy. The plot of FIG. 1 demonstrates lithium concentration in a typical Al-Li alloy as a function of distance from a sample surface subjected to heat treatment in the prior art "wet" carbon dioxide atmosphere The pressure of the water vapor in the "wet" carbon dioxide environment was approximately 4.5 Torr. The alloy employed has approximately 2.5 percent lithium concentration by weight. The alloy is commercially available and is designated as alloy 8091. The normal Li composition range of this alloy is 2.3 to 2.6 percent The plot of FIG. 1 illustrates the resulting lithium concentration as a function of distance, after 16 hours of solution heat treatment at 500° C. The plot demonstrates the relatively sharp loss of lithium near the surface of the heat-treated material. The substantial lithium loss near the surface of the material may create porosity in this region, as was discussed in the Background of the Invention. Such lithium loss reduces the strength of the surface region and the resulting porosity may lead to poor fatigue resistance and to corrosion coupled with finishing problems.

Figure 2:
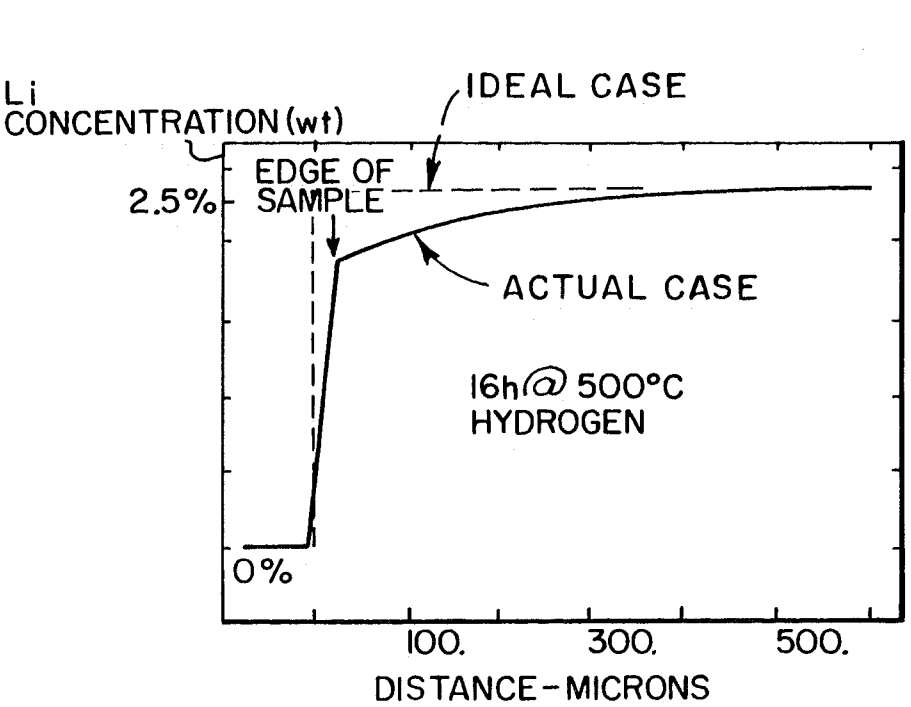
FIG. 2 is a similar graphical plot for the alloy in accordance with the present invention, namely in a hydrogen atmosphere.

FIG. 2 illustrates the resultant lithium concentration, using the identical heat treatment conditions and alloy material as was employed in testing the atmosphere of the prior art, with the one exception that the prior art atmosphere was replaced with a hydrogen atmosphere. The hydrogen atmosphere employed in the experiment depicted in FIG. 2 was 99.9995 percent pure and was at a pressure of approximately 760 Torr. It is anticipated that hydrogen of lesser purity could be used at lower pressure if required.

The results of FIG. 2 show an impressive improvement in retention of lithium concentration near the surface of the sample tested. The result is a far greater lithium concentration in a more extensive region of the alloy, near the surface, as compared with the prior art atmosphere discussed in connection with FIG. 1. Thus, the hydrogen atmosphere suppresses the loss of lithium and thus the formation of porosity.

Accordingly, with the present invention, a reduction atmosphere is employed to sharply reduce reaction of lithium atoms with atmosphere components which would create a diffusion of lithium atoms toward the surface where they would react and be lost to the sample. This loss may also cause agglomerated vacancies in the nature of porosity within the body of the material The result of employing the present atmosphere during Al-Li heat treatment is the elimination of lithium loss and such porosity so that material strength can be maintained through the heat treatment process.

Although the present invention has been discussed in terms of a hydrogen-reducing atmosphere, it is contemplated that the advantageous results of the present invention can be obtained with other reducing atmospheres.

It should be understood that the invention is not limited to the exact details of construction shown and described herein for obvious modifications will occur to persons skilled in the art.

We claim:

1. A method for suppressing Li loss due to oxidation of Li-Al alloys during heat treatment which comprises carrying out the heat treatment in an atmosphere of hydrogen.

2. A method for suppressing Li loss in an aluminum alloy member during metal treatment, the member having a substantial Li content, the method comprising the steps:

subjecting the member to heat treatment at a preselected time period for a preselected temperature, and maintaining the member in an atmosphere of hydrogen during the heat treatment.

3. The method set forth in claim 2 wherein the total nitrogen and oxygen impurity of the atmosphere is less than 1 percent.

* * * * *